United States Patent [19]

Brown et al.

[11] Patent Number: 4,815,256

[45] Date of Patent: Mar. 28, 1989

[54] CAPPED CONTAINER DISPENSER

[75] Inventors: Thomas R. Brown, Milton; Frederick E. Hurd, Toronto; Daniel A. Moyer, St. Catharines, all of Canada

[73] Assignee: BHMW Partnership, Toronto, Canada

[21] Appl. No.: 69,079

[22] Filed: Jul. 2, 1987

[51] Int. Cl.[4] ..... B65B 43/38; B65B 43/39

[52] U.S. Cl. ..... 53/468; 53/469; 53/281; 53/300; 53/381 A

[58] Field of Search ..... 53/459, 468, 469, 300, 53/381 R, 381 A, 382, 281

[56] References Cited

U.S. PATENT DOCUMENTS

| | | | |
|---|---|---|---|
| 2,284,660 | 6/1942 | Hothersall et al. | 53/382 |
| 2,673,020 | 3/1954 | Almgren et al. | 53/382 |
| 2,821,824 | 2/1958 | Knappe | 53/382 X |
| 2,940,229 | 6/1960 | Baker . | |
| 2,990,073 | 6/1961 | Textor | 53/381 A X |
| 2,995,883 | 8/1961 | Aubry et al. | 53/381 A |
| 3,242,951 | 3/1966 | Curie et al. . | |
| 3,299,606 | 1/1967 | Weikert . | |
| 3,447,281 | 6/1969 | Buford et al. | 53/381 A |
| 3,513,621 | 5/1970 | Chamberlin | 53/381 A X |
| 3,529,399 | 9/1970 | Schieser et al. . | |
| 4,120,134 | 10/1978 | Scholle . | |
| 4,283,901 | 8/1981 | Schieser et al. . | |
| 4,363,203 | 12/1982 | Marshall et al. . | |
| 4,363,338 | 12/1982 | Brown | 53/381 A X |
| 4,446,674 | 5/1984 | Inada | 53/381 A X |
| 4,494,363 | 1/1985 | Rica et al. . | |
| 4,510,737 | 4/1985 | Ellert . | |
| 4,524,563 | 6/1985 | Sassi . | |
| 4,530,202 | 7/1985 | Powell et al. | 53/468 X |
| 4,574,559 | 3/1986 | Rutter et al. | 53/381 A X |
| 4,608,803 | 9/1986 | Araki . | |
| 4,620,411 | 11/1986 | Schieser et al. . | |

FOREIGN PATENT DOCUMENTS

| | | |
|---|---|---|
| 1005027 | 2/1977 | Canada . |
| 1147307 | 5/1983 | Canada . |

*Primary Examiner*—Horace M. Culver

*Attorney, Agent, or Firm*—Patrick J. Hofbauer

[57] ABSTRACT

A bulk filling station, for dispensing containers filled with a predetermined quantity of a bulk liquid, stores the plastic containers in an empty condition, having hinged closures installed thereon. The operation of filling the containers, individually, is carried out by the subject apparatus, including the steps of feeding and selecting an individual container, positioning the container, opening the closure thereon, filling the container with a predetermined quantity from a bulk supply, closing the container and delivering it to the vending station. The preferred closure incorporates a child-resistant safety lid to permit the dispensing of noxious substances.

27 Claims, 8 Drawing Sheets

D

CAPPED CONTAINER DISPENSER

FIELD OF THE INVENTION

This invention relates generally to a liquid dispensing system and in particular to a method of dispensing liquids from a bulk liquid supply on a demand basis and to a dispensing apparatus for carrying out such method.

BACKGROUND AND SUMMARY OF THE INVENTION

In mass merchandizing the need for optimizing merchandizing efficiency becomes ever more pressing.

In the case of certain liquid products, such as for example, automobile windshield washer anti-freeze, oil and the like, and comestibles such as milk, wherein large volumes of product are sold, the space requirements necessary to carry an extensive inventory of pre-packaged stock can prove very expensive. Moreover, the constant re-stacking and re-organization of product display shelves is labour intensive.

An alternative method of merchandising these goods, which solves the space problem, is to provide in-store dispensing of the liquids from bulk supply. Where such dispensing is manual, it can be carried out either by the purchaser or by retail store personnel. The former is not a practical alternative in many cases, and may be restricted by health, safety and marketing considerations with respect to certain goods. The latter solution of using store personnel is again labour intensive, so as not to be cost effective and may also be negatived by health, safety and marketing considerations. Therefore, while large savings can potentially be made in transporting the liquid by tank truck or other similar bulk transport vehicle directly from the source of supply to the retail outlet, the costs, complexities and liabilities of dispensing the liquid remain to be dealt with.

Currently known vending machines can be seen as a partial solution to the floor space and re-stocking problems, but are not readily adaptable to a wide range of products and do not provide the savings of a system allowing for on-site bulk dispensing of liquid or other flowable products.

While automatic machines for filling containers with liquid are well known, such machines are typically part of a high volume packaging line and, as such, are not suited for on-site installations in retail sales outlets.

It is, therefore, an object of the present invention to provide a method for automatically dispensing liquid or other flowable products from a bulk supply into individual containers, upon demand, which method is suitable for on-site use, such as for example, in retail sales establishments.

A further object of the present invention is to provide an apparatus for the automatic dispensing of liquids or other flowable products from a bulk supply into individual containers, upon demand, which apparatus is sized and otherwise suited for operative installation in retail sales establishments.

Thus, there is provided, according to one aspect of the invention, a process of machine dispensing a discrete quantity of a bulk liquid into a container having a hinged closure fitted on a neck portion of the container in a closed configuration. The process comprises, in order, the steps of: mechanically selecting the container from an aligned stack of similar containers; mechanically positioning the selected container in a predetermined filling position with the closure in predetermined indexed relation to the container; mechanically opening the closure to access the container; mechanically introducing a metered quantity of the bulk liquid into the container through the opened closure; mechanically closing the closure to seal the container; and, mechanically delivering the sealed container of liquid to a dispensing access of the machine.

According to another aspect of the invention, wherein the process of the invention is practiced with a hinged closure having an annular rim portion and a hinged lid portion, the closure opening step includes the sub-step of radially compressing a pressure sensitive area of the rim portion so as to initially open the hinged lid portion to an open condition, and, thereafter, applying an opening force against the operative underside of the lid portion thereby to displace the hinged lid portion of the closure through a predetermined distance to affect an operative degree of opening thereof.

Moreover, in yet another process aspect of the invention, the containers are vertically stacked and the selection step additionally includes displacing the selected container from an aligned uppermost position in the stack by gripping the neck portion of the container and withdrawing the container from the stack. In this aspect, the positioning step also includes pivoting of the selected container so gripped in downward pivoting motion about the neck portion thereof into the filling position, at which filling position the container is in a substantially vertically suspended configuration with the neck portion substantially vertically oriented.

In yet a further embodiment of the inventive process, the aforementioned pivoting of the selected container into the filling position causes the pressure-sensitive area of the rim portion to contact an abutment means, such contact radially compressing the pressure-sensitive area so as to initially open the hinged lid portion for further opening action.

The invention further relates to a container filling and dispensing apparatus for use with a plurality of containers each having a mouth providing access to the interior of the container and a closure having a hinged lid portion positionable over the mouth for closing of the container, the apparatus comprising: magazine means adapted for receiving the plurality of containers in oriented stacked relation therein; container positioning means for relocating a selected one of the stacked containers to a predetermined operative filling position; opening means for opening the closure of the selected container; liquid dispensing means for dispensing a metered quantity of a bulk liquid through the mouth into the interior or the selected container at the filling position; closing means for closing the closure of the selected container in sealing relation with th mouth, and, means to deliver the selected container to a dispensing access of the apparatus.

According to yet another aspect of the invention there is provided an apparatus for filling and dispensing containers each having a neck portion defining a generally circular opening to the container and a closure positioned on the neck portion. The closures each have a rim portion grippingly surrounding the neck portion and a lid portion connected by hinge means to the rim portion so as to selectively seal the opening. The apparatus comprises: cabinet means forming a housing; first trolley means mounted within the housing so as to be movable in first and second opposed longitudinal directions; magazine means postioned within the housing and adapted to receive a plurality of the containers in oriented stacked relation therein with the neck portions of the containers protruding from the magazine means substantially in the first longitudinal direction; gripper means pivotally mounted on the first trolley means and adapted for gripping a selected one of the containers about the neck portion for withdrawal of the selected container from the magazine means upon movement of the first trolley means in a first longitudinal direction and for pivoting the gripped container to a filling position whereat the neck portion is oriented generally transversely to the first and second longitudinal directions; opening means mounted on the first trolley means and adapted for movement in the longitudinal directions relative to the first trolley means and for engagement with the operative underside of the lid portion when moving in the second longitudinal direction, thereby to urge the lid portion to an operatively open position, at which open position the opening means are clear of the container opening; filler means having a dispensing nozzle mounted within the housing, which nozzle is adapted to be positionable over the opening when the lid portion is in the operatively open position, thereby to allow filling of the selected container with a metered quantity of a flowable substance, and which nozzle is adapted for withdrawal clear of the closure subsequent to the filling; closing means mounted on the first trolley means and adapted for movement in the first and second longitudinal directions relative to the trolley means in coordination with the movement of the opening means so as to engage the operative top surface of the lid portion subsequent to the withdrawal of the dispensing nozzle, thereby to seal the opening; release means positioned within the housing and adapted to cause release of the selected container from the gripper means after filling and sealing of the selected container; and, delivery means adapted to deliver the filled and sealed container from the point of the release to a user dispensing area.

According to a further development of the apparatus of the invention, an abutment means is mounted on the first trolley means and is adapted to affect the aforementioned hinged opening of the lid portion by contacting a pressure-sensitive area of the rim portion of the hinged closure upon pivoting of the selected container to the filling position thereby to apply a radially directed force of threshold magnitude to a pressure-sensitive area of the rim portion.

In yet a further aspect of the inventive apparatus, the magazine means comprises a plurality of magazine means arranged within the housing to define first and second opposed lateral directions. The device additionally comprises a second trolley means upon which the first trolley means is mounted for independent movement in the first and second longitudinal directions as aforesaid. The second trolley means is itself mounted within the housing so as to be independently movable in the first and second opposed lateral directions so as to be selectively positionable adjacent a selected one of the plurality of magazine means. This arrangement thereby allows the gripping of the selected container by the gripper means from the selected one magazine means.

In a preferred embodiment of the invention, the plurality of magazine means is each separately tiltable in the second longitudinal direction from an operative rest position upon urging contact by the first trolley means so as to partially displace a selected one of the stacked containers from its oriented stacked relation within the respective magazine means for gripping by the gripping means. Furthermore, in the preferred embodiment, the filler means includes displacement means adapted to provide relative displacement of the nozzle into operative engagement with the opening to facilitate the aforementioned filling of the selected container. The displacement means is preferably mounted on a third trolley means carried by the first trolley means, which third trolley means is adapted for independent movement in the first and second longitudinal directions.

BRIEF DESCRIPTION OF THE DRAWINGS

In order that the invention may be readily understood, one embodiment thereof will now be described by way of example, with reference to the accompanying drawings in which.

DESCRIPTION OF A PREFERRED EMBODIMENT OF THE INVENTION

Figure 1:
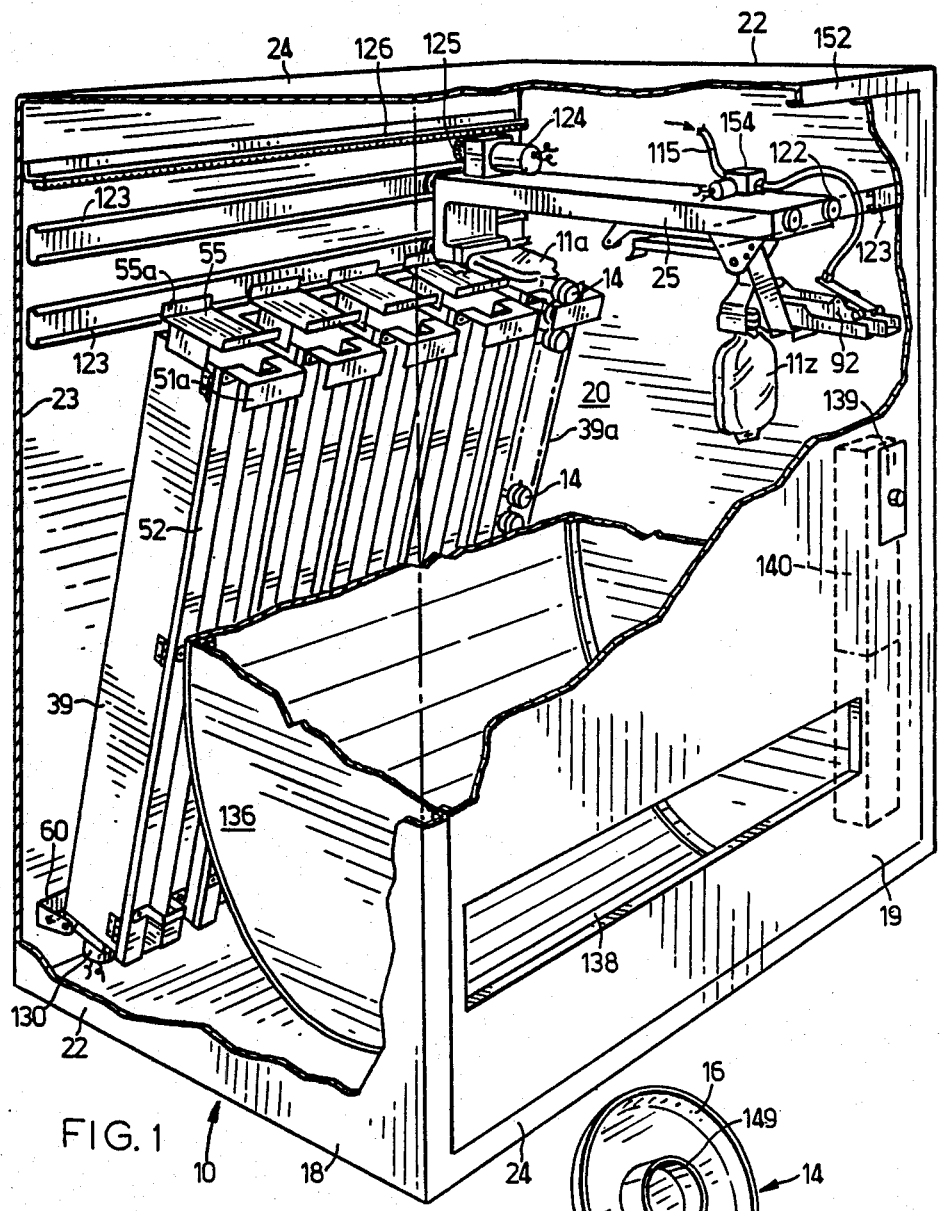
FIG. 1 is a breakaway perspective view of an apparatus for filling and dispensing containers according to a preferred embodiment of the invention, which apparatus performs the process of the invention.

FIG. 1 shows a microprocessor controlled vending apparatus, generally designated by the reference numeral 10, constructed according to the invention for filling and dispensing a plurality of containers 11 each having a neck portion 12 defining a generally circular opening 13 to the container and a closure 14 positioned on the neck portion 12. The preferred closure 14 illustrated is a proprietary safety closure available from Polytop Inc., of Slatersville, R.I., U.S.A. While it is generally preferable to use a child-resistant safety closure of this general type when vending potentially noxious substances such as automobile windshield washer anti-freeze or the like, the present invention is not to be restricted to use with such safety closures, nor to any particular hinged closure, so long as the closure is adapted for hinged opening in the manner contemplated by the claims.

Figure 1A:
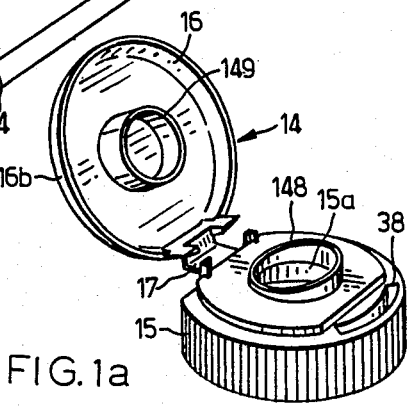
FIG. 1*a* is a perspective view of a container closure for use in the process and with the apparatus of the invention.

As seen best in FIG. 1*a*, the preferred closure 14 has a rim portion 15 grippingly surrounding the neck portion 12, having a filling and dispensing opening 15*a* therein, and a lid portion 16 connected by hinge means in the form of a strap 17 to the rim portion 15 so as to selectively seal the opening 15*a* upon closure of the lid portion. The rim portion 15 grippingly surrounds the neck portion 12 and is held fast thereon by conventional means such as complimentary screw threading (not shown) or snap-fitting over an interference rim on the neck portion 12 (also not shown). Moreover, the patented closure 14 illustrated is a child-resistant safety closure wherein the rim portion 15 is adapted to facilitate initial hinged opening of the lid portion 16 upon application of a radially directed compressive force of threshold magnitude to a pressure-sensitive area 38 of the rim portion 15. The closure 14 is preferably moulded in one piece of moderately resilient plastics materials.

The apparatus 10 comprises a substantially cuboidal cabinet means 18 which is formed by opposed side walls 22, opposed top and bottom walls 24, rear wall 23 upper front wall 152 and front access door 19. The access door 19 is hinged at the front left corner of FIG. 1 to open outwards so as to provide servicing access to an interior housing 20 formed by the cabinet means 18 and to the operative components of the apparatus as described below.

A first trolley means 21 is mounted on a second trolley means 25 within the housing 20 so as to be movable in first and second opposed longitudinal directions. The first longitudinal direction is, in the preferred embodiment illustrated, towards the access door 19 (i.e. in the direction of the arrow A of FIG. 5) and the second longitudinal direction is in the opposite direction towards the rear wall 23 of the cabinet means 18 (i.e. in the direction of the arrow B of FIG. 2*a*), but these two terms are not used in this absolute sense in the claims, where they are used in a relative sense so as to be distinguishable from the terms "first lateral direction" and "second lateral direction", which are more fully defined below.

Figure 3A:
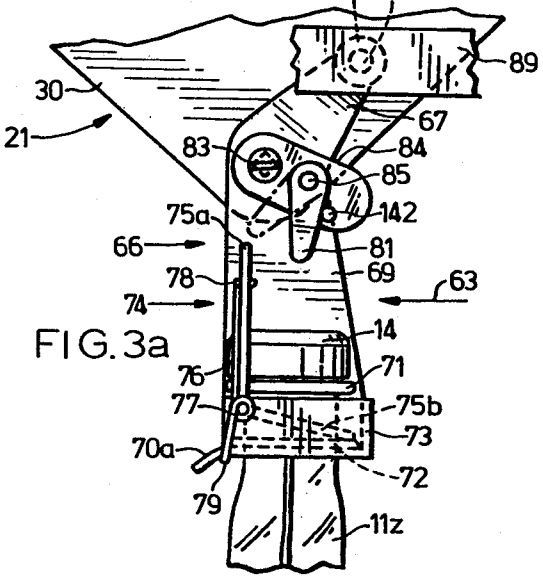
FIG. 3*a* is a side elevational view of the mechanism of FIG. 3, taken in the direction of an arrow G shown in FIG. 3.
Figure 3:
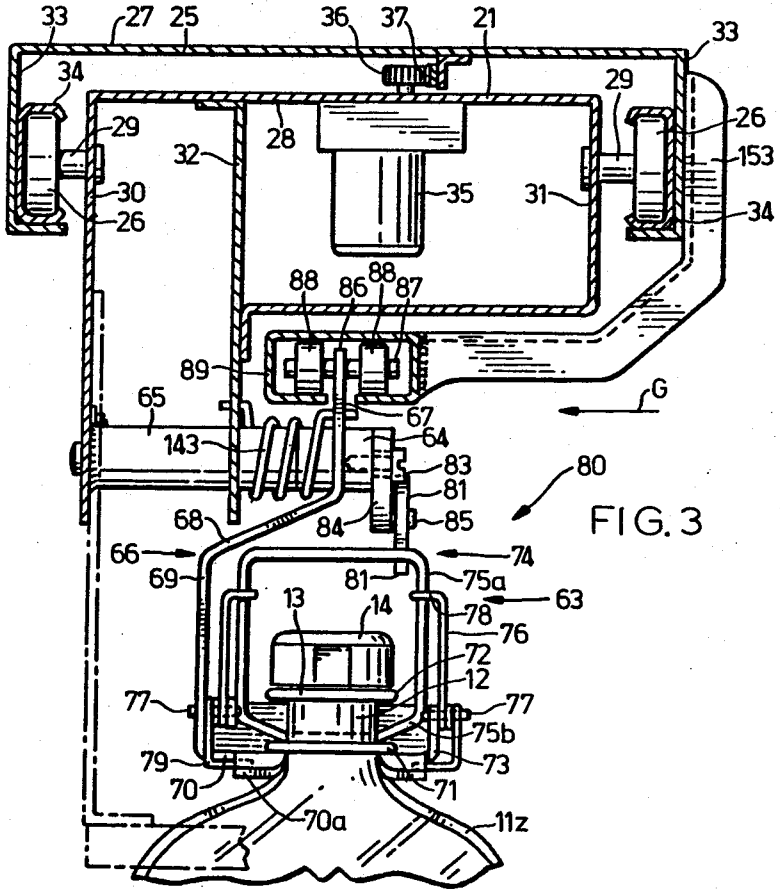
FIG. 3 is a partial sectional view along broken line 3—3 of FIG. 2.

As shown in the Figures, particularly FIG. 3, the first trolley means 21, is mounted on the second trolley means 25 for independent longitudinal movement in the first and second longitudinal directions as aforesaid by means of four side casters 26, which are mounted for rotation on axles 29 affixed two each in projecting coaxial relationship on opposed first 30 and second 31 down plates of the first trolley means 21 adjacent the respective four corners of a generally rectangular top plate 28. The casters 26 roll in side tracks 34 affixed to opposed side panels 33 of the second trolley means 25. An electrically driven motor means 35, under the control of a suitably programmed microprocessor means (not shown), is mounted to the underside of the top plate 28 and is drivingly connected by a pinion 36 to a rack means 37 rigidly mounted on the underside of the top plate 27 of the second trolley means 25 so as to provide for controlled movement of the first trolley means 21 in said first and second longitudinal directions as required.

A plurality of magazine means, each designated by the general reference numeral 39, are arranged within the housing to define first and second opposed lateral directions, which directions are at substantially right angles to said first and second longitudinal directions and to the plane of the access door 19. One of the magazine means 39 is shown in greater detail in FIG. 10, where it will be seen that it is adapted to receive a plurality of the containers 11 in oriented stacked relation therein, with the neck portions 12 protruding from the magazine means 39 substantially in the first longitudinal direction (i.e., towards the access door 19). The containers 11 are preferably constructed of low density polyethylene material and are received in the magazine means 39 in doubled-over relation, being at least partially evacuated prior to stacking so as to minimize space requirements, and so as to allow for generally uniform stacking within a cardboard container sleeve 40.

Figure 10:
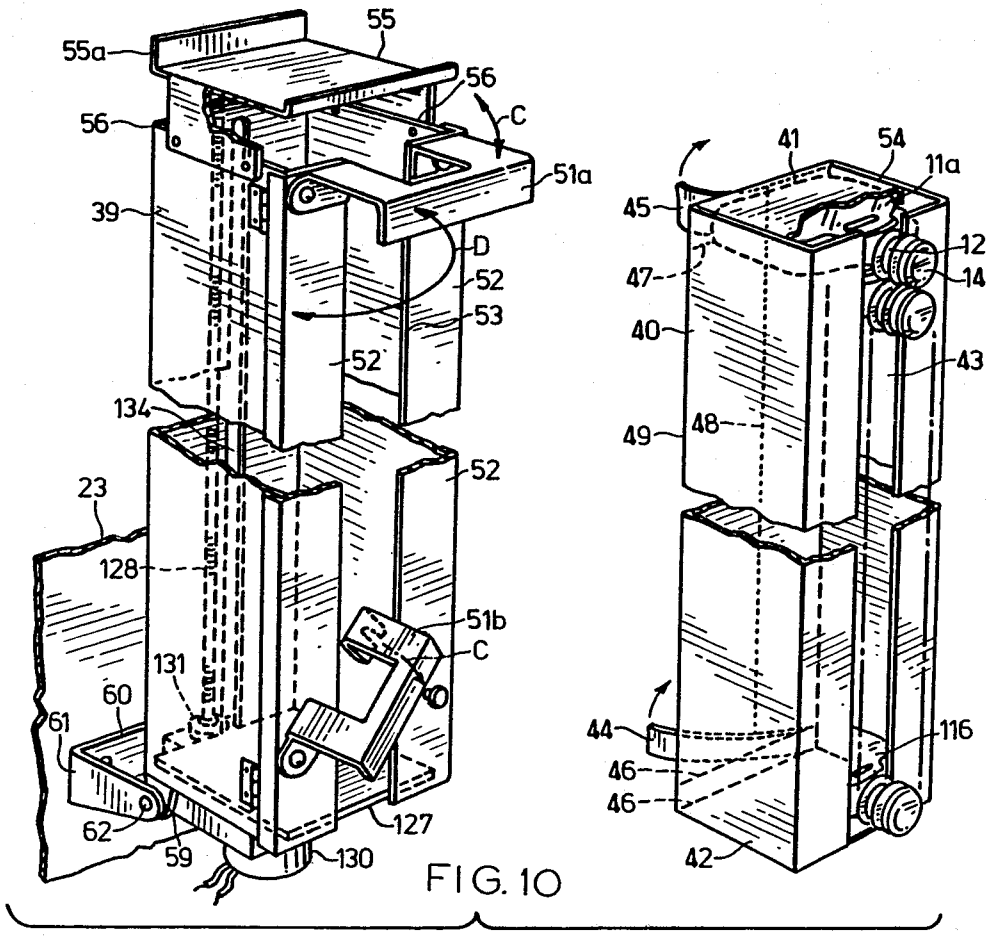
FIG. 10 is a perspective view on a larger scale of one of the plurality of magazine means shown in FIG. 1, showing a carton of stacked containers adapted for insertion into the magazine means.

The cardboard sleeve 40 is dimensioned to slide easily into and out of the magazine means 39, so as to allow the unloading of empty sleeves 40 and the loading of fresh sleeves filled with stacked containers 11. As seen in FIG. 10, the sleeves 40 are closed at their top 41 and bottom 42 ends, but have a vertically oriented longitudinal front slot 43 to accommodate the necks 12 of the containers 11 in protruding stacked relation, as previously referred to. When a fresh sleeve 40 loaded with container 11 is required for loading into the apparatus 10, a bottom rear pull-tab 44 is torn from the bottom rear corner of the sleeve 40 along perforations 46 so as to allow rear access to the bottomost container 11*b*. A similar top rear pull-tab 45 is then torn from the uppermost corner of the sleeve 40 along perforations 47, so as to allow rear access to the uppermost container 11*a*. A perforation line 48 runs up the middle of the back panel 49 of the sleeve 40 in connecting relationship with the perforations 46 and 47, and the function thereof will become more apparent as this description progresses. The top and bottom ends must also be torn away from the cardboard sleeve 40 prior to insertion into the magazine means 39, so as to fully expose the top face of the uppermost container 11*a* and the bottom face of the bottomost container 11*b*. Once the tabs and ends are torn away from the sleeve 40, the sleeve can then be slid into the central cavity provided by the magazine means 39 upon unlatching top and bottom latch members 51*a* and 51*b* (arrow C) (bottom latch 51 being shown unlatched, while top latch 51 is shown latched) and opening front wall members 52 of the magazine means by hinging them about respective hinge members as indicated by arrows D. The sleeve 40 is slightly longer than the walls of the magazine means 39, so that when inserted into the housing, the top edge 54 of the sleeve 40 contacts the underside of a top end member 55, which top end member 55 is rigidly fastened to be positioned above and adjacent to the upper free edge 56 of the magazine means 39 in spaced relationship to said edge 56. The sleeve is dimensioned so that, when loaded into the magazine housing, it protrudes sufficiently above the top of the upper free edge 56 to allow the uppermost container 11*a* to clear the upper free edge 56 when urged in the first longitudinal direction in a manner described below.

The magazine housing, which is preferably constructed of sheet metal or other suitable materials, is of generally rectangular section and, as described above, is sectionally dimensioned to receive the sleeve 40 in its central cavity in a close sliding fit. The front wall members 52 of the housing form a longitudinal slot 53 which is adapted to overlie, in aligned registering relation, the slot 43 of the cardboard sleeve 40 so as to allow the neck portions 12 of the containers 11 to protrude therethrough.

The upper latch member 57*a*, being affixed to the housing 52 adjacent the top end of the housing 52, not only adds a degree of rigidity to the housing structure, but protrudes in the first longitudinal direction and provides a platform which facilitates egress of the uppermost container 11*a* from its position atop the stack of containers 11 loaded into the magazine means 39, as will become apparent hereinafter. The lower latch member 51*b* being affixed lower down on the front face of the magazine housing adds a further degree of rigidity thereto, and is also adapted to protrude in the first longitudinal direction beyond the plane of the front of the housing 52. Both of the latches are slotted in registration with the front slot 53 in order to freely pass the protruding closures 14 affixed to the neck portions 12 of the stacked containers 11.

In FIG. 1 the magazine means are all shown in their operative rest positions and only the right-most magazine means 39 is shown stacked with containers 11. It will also be noted that the housings 52 are not entirely upright in the operative rest positions illustrated, but are tilted somewhat in the first longitudinal direction, i.e., towards the access door 19, and are mounted for pivoted tilting movement in the first and second longitudinal directions. This tilting feature is accomplished in a manner best seen in FIG. 10. That is, the bottom of each magazine housing is fitted at both rear corners with an ear 59. A U-shaped bracket 60 is affixed to the rear wall 23 of the apparatus housing 20 and its side arms 61 surround the ears 59 of each magazine housing 39 in overlapping relation. A pivot pin 62 connects each arm 61 to its respective ear 59 so as to allow hinged pivoting of the associated magazine housing. Tilting of the magazine housings in the first longitudinal direction not only facilitates loading and unloading of the cardboard sleeves 40 into the housings when accessed from the access door 19, but also accommodates removal of the uppermost container 11*a* from the stack of similar containers 11 upon urging contact by the first trolley means 21, as will become more apparent below.

A gripper means, (see especially FIG. 3) generally designated by the reference numeral 63, is pivotally mounted on the first trolley means 21 by means of a pivot shaft 64 mounted to a shaft housing 65 which housing 65 is rigidly affixed between the first down plate 30 and an intermediate down plate 32 of the first trolley means, as seen most clearly in FIG. 3. The pivot shaft 64 is preferably longitudinally adjustable relative to the housing 65 as by screw-threading (not shown) so as to allow adjustment of clearance between the housing 65 and a mounting plate 84 attached to the pivot shaft 64. The gripper means 63 is adapted for gripping the uppermost container 11*a* about the neck portion 12, for withdrawal of said container 11*a* from the magazine means 39 upon movement of the first trolley means 21 in the first longitudinal direction the gripper means then pivoting to move the selected gripped container (now labelled 11*z* in FIGS. 2 and 3) to a filling position illustrated in solid outline in FIG. 2 in the following manner.

The gripper means 63 comprises a first gripping element 66 which is pivotally connected to the first trolley means 21 via a first straight portion 67 mounted on the pivot shaft 64. An off-set portion 68 extends in an angled direction towards the first down plate 30 (as best seen in FIG. 3) and the gripper means thence continues as a second straight portion 69 in the same direction as the first straight portion 67 to a terminal end portion 70, which terminal end portion 70 is oriented generally transversely at right angles to the second straight portion 69. Moreover, the terminal end portion 70 presents a generally U-shaped slot (see also FIG. 9) which is dimensioned to grippingly surround the neck portion 12 of the selected container 11*z* between first 71 and second 72 spaced ribs surrounding the container neck 12. A reversed straight portion 73 extends in reverse direction from the opposite end of the terminal end portion 70 in generally parallel relation to the second straight portion 69.

A second gripping element 74 in the form of a transversely bent wire bail loop is pivotally mounted in the first gripping element 66 by means of pivot pins 77 for operative gripping of the neck portion 12 of the selected container 11*z*. The bail loop has a first portion 75*a* which, in the operative position shown in FIG. 3*a*, is generally parallel to the longitudinal axis of the neck portion 12 of the selected container 11*z*, and a second portion 75*b* which, in the same position, is generally transverse to the first portion 75*a* and to the aforesaid longitudinal axis of the neck portion 12. Two bail springs 76 are positioned one each side of the bail loop, each being centrally looped around the respective pivot pin 77, having one free end 78 engaging the first portion 75*a* of the bail loop, and having the other free end 79 engaging a downturned portion 70*a* of the terminal end portion 70 of the first gripper means 66, so as to bias the bail loop 75 into gripping relation with the terminal end portion 70 of the first gripping element 66, until such time as the spring biasing provided by the bail springs 76 is released by a release means generally designated by the reference numeral 80.

The release means 80 comprises the mounting plate 84 which is rigidly attached by a bolt 83 to the adjacent end of the pivot shaft 64, which plate 84 serves as a spacer between the first gripper element 66 and a trip lever 81 which is pivotally mounted on the mounting plate 84 for pivotal movement about a mounting pin 85, as best seen in FIGS. 3 and 3*a*. A stop pin 142 restricts the pivotal movement of the trip lever 81 in the anticlockwise direction (as seen in FIG. 3*a*), as the first trolley means 21 moves in the second longitudinal direction, so that the trip lever can positively engage the first portion 75*a* of the bail loop upon pivotal movement of the attached first gripper means 66 in the second longitudinal direction (i.e., to the right of FIG. 3*a*) thereby to counter the spring biasing of the bail loop by the bail springs 76, so as to cause release of the selected container 11*z* from the gripping means after filling and sealing of the selected container 11*z*, as described more fully below.

It will be apparent from FIG. 3*a* that the trip lever 81 in the position shown in phantom outline in FIG. 3*a* is free to slide over the first portion 75*a* of the bail loop as the first gripper element 66 pivots about the pivot shaft 64 in the clockwise direction (as seen in FIG. 3*a*), that is, as the first trolley means 21 moves in the first longitudinal direction (to the left of FIG. 3*a*), thereby allowing the gripping means to maintain a gripping hold on the selected container 11*z* during and after such passage.

The first straight portion 67 of the first gripper element 66 continues past its point of pivotal mounting on the pivot shaft 64 to a terminal end portion 86 which presents a fixed axle 87 extending on either side of the terminal end portion 86. Rollers 88 are mounted for free rotation on each of the protruding ends of the axle 87 and are fitted for guided movement in a contoured guide track 89 rigidly fitted to the second trolley means 25 by means of a plurality of support members 153. As the first trolley means 21 and the associated gripper means 63 travel in the first or the second longitudinal directions, the rollers 88 follow the contour of the guide track 89 so as to cause controlled pivotal movement of the first gripper element 66 and the associated structures of the gripping means 63 previously described.

Referring now particularly to FIGS. 6 to 9, an opening means generally designated by the reference numeral 85, in the form of a wedge means 90, is positioned in bridging relation between the parallel arms 91 of a third trolley means 92, which third trolley means 92 is adapted for independent driven movement in said first and second longitudinal directions by means of roller means 93 (FIG. 6) side-mounted, in two longitudinally spaced coaxial pairs, on the lower edges of the third trolley means 92. The third trolley means is guided in said first and second longitudinal directions by means of opposed guide tracks 94 along which the roller means 93 roll. The guide tracks 94 are rigidly mounted in a trough portion, generally designated by the reference numeral 95, which trough portion 95 is downwardly suspended from the first down plate 30 of the first trolley means 21 by means of a hanger bracket 96. In this manner, the third trolley means 92 is carried by the first trolley means 21.

The third trolley means 92 is driven in said first and second longitudinal directions by means of an electrical motor 97 mounted on the trough portion 95 with a drive pinion 98 protruding through an opening 99 in the bottom plate 100 of the trough portion 95 to drivingly engage a rack member 101 operatively affixed to the underside of the bottom plate 102 of the third trolley means 92. The electrical motor 97 is under timed control of the programmed microprocessor control means (not shown). In this manner, the wedge means 90 is structurally connected to the third trolley means 92 for coordinated travel therewith in the first and second longitudinal directions.

Figure 6:
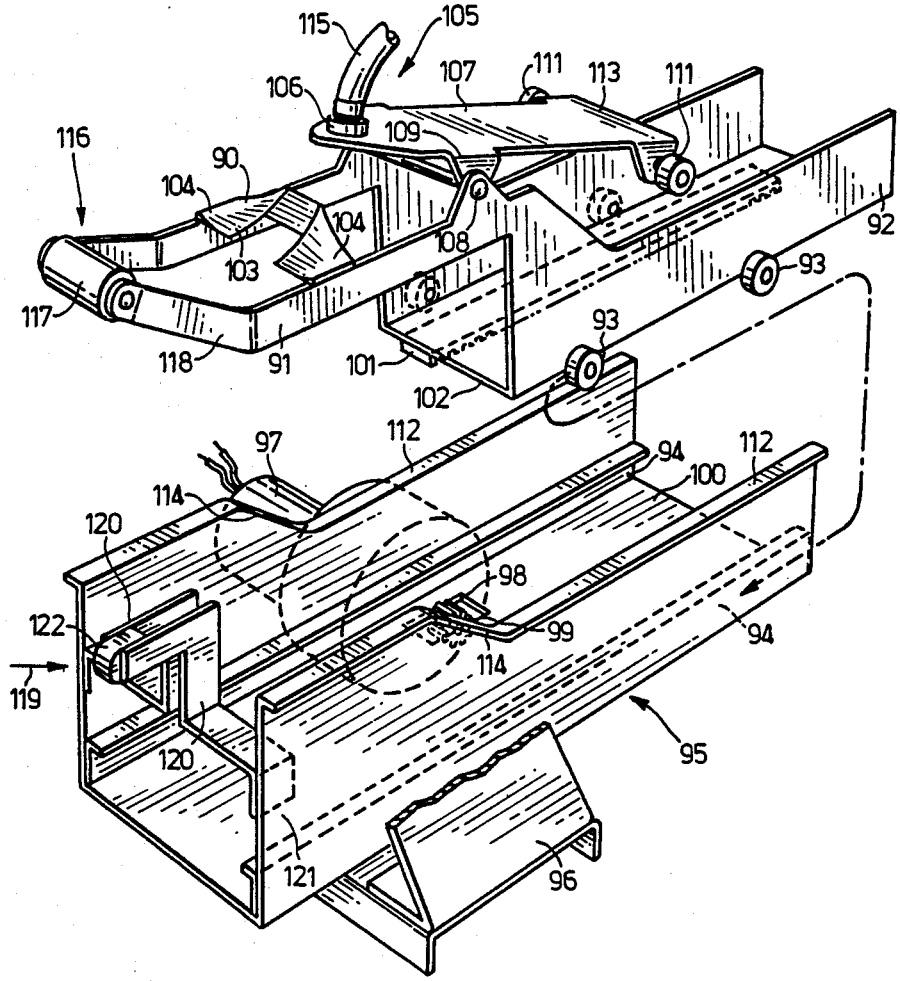
FIG. 6 is a partially exploded view of a third trolley means mounted on a portion of the first trolley means.

As best seen in FIG. 6 the wedge means 90 is comprised of a central ramped portion 103 between two side portions 104 and providing a neck-receiving slot. The central portion is somewhat shorter in a longitudinal sense than the side portions 104, and is vertically angled somewhat steeper than the two side portions 104. The two side portions are angled both upwardly and inwardly towards the central portion 103. With this arrangement the wedge means 85 is adapted for engaging an operative underside 16*a* of the lid portion 16 of the closure 14 as the wedge means 90 moves with the third trolley means 92 in the second longitudinal direction, so as urge the lid portion 16 to an operatively open position, shown in FIGS. 8 and 9, at which position the opening means 85 are clear of the container opening 13. This movement will be described more fully below.

Figures 8, 9:
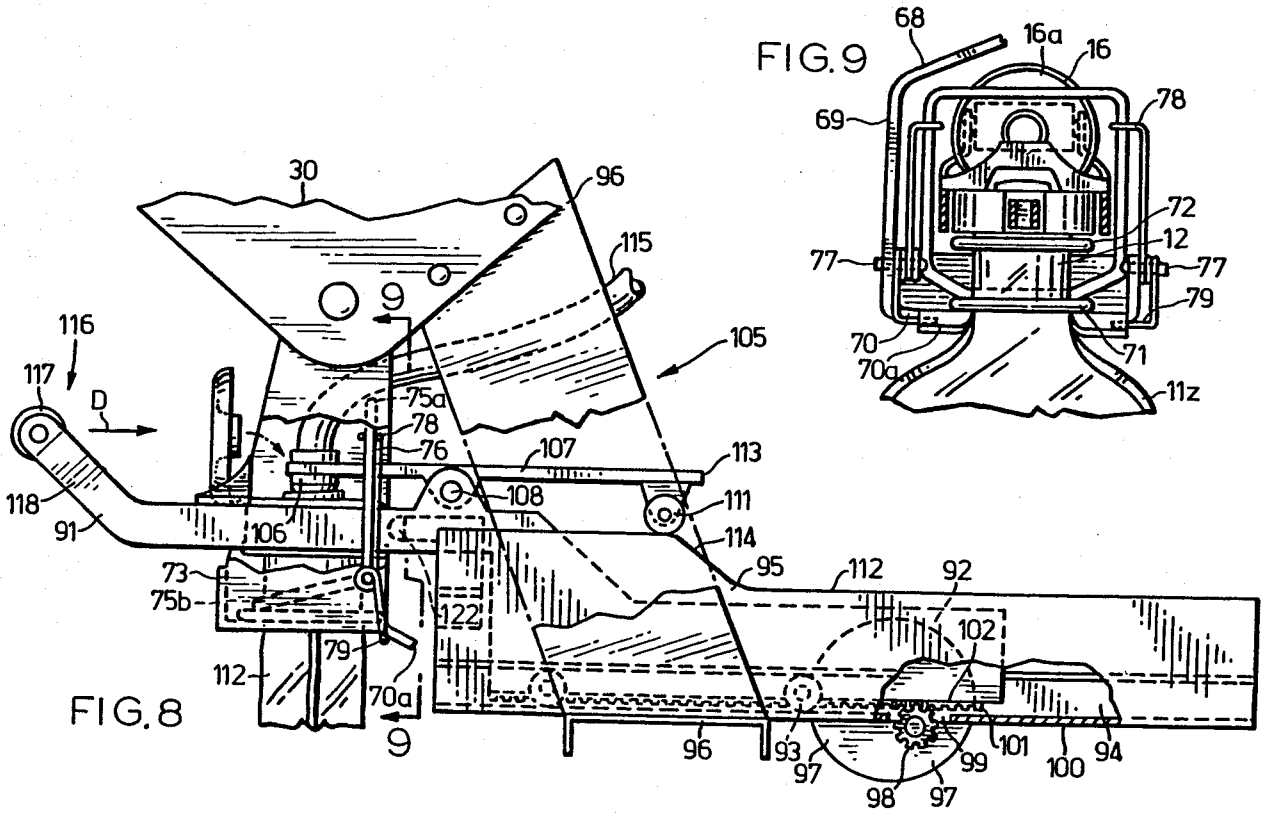
FIG. 8 is a view similar to FIG. 7, wherein the lid portion of the selected container has been moved to an operatively open position and wherein a dispensing nozzle has been positioned over the opening to the selected container for filling of the container.
FIG. 9 is a sectional view along line 9—9 of FIG. 8.

A filler means, generally designated by the reference numeral 105, comprises a dispensing nozzle 106 (best seen in FIG. 7), which nozzle 106 is adapted to be positionable over the container closure opening 15*a* when the lid portion 16 is in the fully operatively open position, as shown in FIG. 8 and to be engageable therewith so as to be able to fill the container 11*z* without spillage. In the preferred embodiment illustrated, such adaptation is obtained through the utilization of a displacement means which forms part of the filler means 105. The displacement means comprises a generally rectangular plate 107 which is centrally pivoted on each side about a pair of pivot pins 108, which pins each engage respective pairs of downturned ears 109 of the plate 107 and of upturned ears 110 of the parallel arms 91 of the third trolley means 92. A pair of coaxial rollers 111 are rotatably mounted on one free end 113 of the plate 107 and are positioned to ride along a parallel pair of contoured tracks 112 formed on the upper free edges of the trough portion 95 of the first trolley means 21, as the third trolley means 92 moves in the first or the second longitudinal directions under the control of the electrical motor 97, as described above. Such movement causes the free end 113 of the plate 107*a* to pivot upwardly as the rollers 111 roll up an upwardly inclined portion 114 of the track 112, with the result that the dispensing nozzle pivots downwardly into operative sealing engagement with a rised lip portion 148 of the rim portion 15 which lip portion 148 surrounds the closure opening 15*a* and is centred over the container opening 13, thereby providing for filling of the selected container 11*z* held by the gripper means 62, as shown in FIG. 8, and as more fully described below.

The filler means also comprises a filling tube 115 connected to the dispensing nozzle 106 which tube 115 is connected to a solenoid driven flow valve 154 and a liquid flow meter (not shown) and both of which are electrically connected in a known manner to the microprocessor control means (not shown).

This arrangement allows for the flow of a metered quantity of a flowable substance through the dispensing nozzle 106 so as to fill the selected container 11*z* to a pre-determined level. The filling tube 115 exits the apparatus housing 20 through, for example, the adjacent side wall 22, and is connected to a conventional bulk storage tank (not shown) remote from the apparatus 10. Instead of course an appropriately dimensioned bulk storage tank (not shown) can be incorporated into the cabinet means 18, for example comprising a container on which the cabinet means sits. Preferably a conventional float valve switch in the bulk storage tank unit is arranged to send an electrical signal to the microprocessor control means to indicate a near empty condition of the bulk storage task and to suspend operation of the apparatus 10 until the tank is refilled.

A closure lid closing means, generally designated by the reference numeral 116, is provided on the first trolley means in the form of a roller means 117 rotatably mounted between the upswept terminal portions 118 of the two parallel arms 91 of the third trolley means 92. By being mounted on the parallel arms 91 of the third trolley means, the roller means 117 is adapted for movement in the first and second longitudinal directions relative to the first trolley means 21 in co-ordination with the movement of the opening means 85, the spacing between the opening means 85 and the closing means 116 being such that they do not interfere with one-another upon said longitudinal movements of the third trolley means 92. Moreover, the upswept terminal portions 118 are dimensioned and the roller means 117 is positioned therebetween so as to engage with the operative top surface 16*b* of the lid portion 16 of the closure 14 upon withdrawal of the opening means 85 in the first longitudinal direction (as indicated by the leftmost arrow D in FIG. 8) subsequent to filling of the selected container 11*z* and withdrawal of the dispensing nozzle 106, (i.e., subsequent to the rollers 111 returning down the inclined portion 114 of the track 112). This engagement causes pivoting of the lid portion 16 in the direction of the broken arrow E of FIG. 8, thereby to seal the opening 15*a*. This operation is more fully described below.

Figure 7:
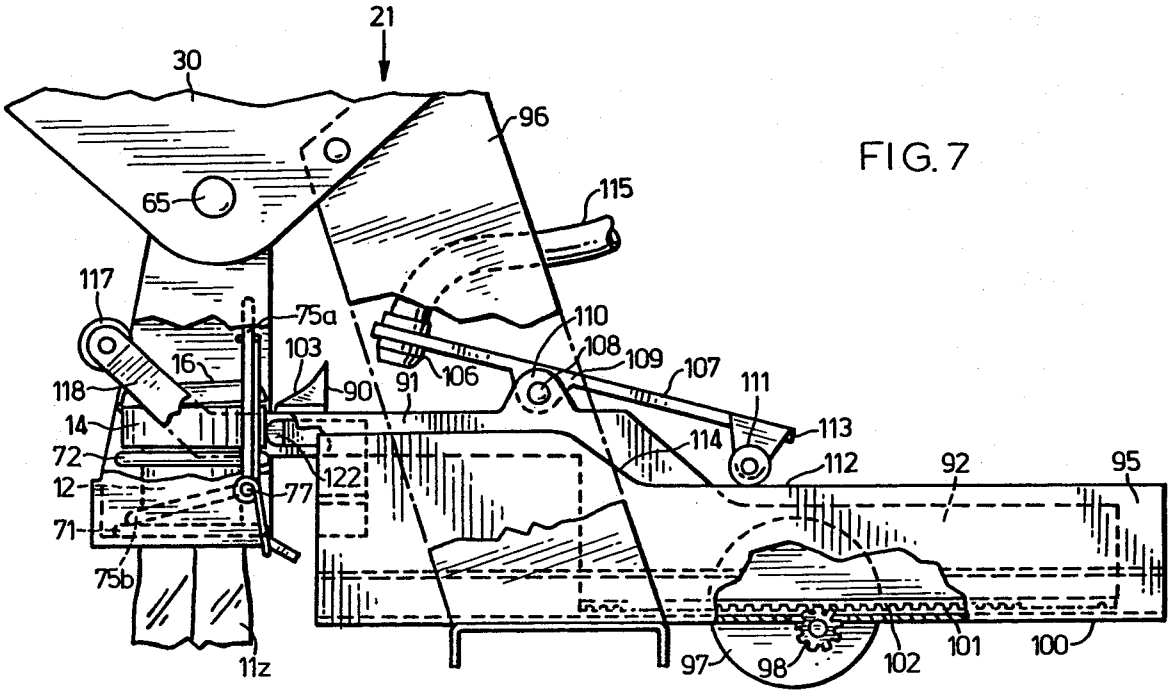
FIG. 7 is a side elevational view of the elements of FIG. 6, shown in their respective operative configuration with the selected container at the filling position prior to opening by the opening means.

An abutment means 119 (best seen in FIG. 6) is mounted on the first trolley means 21 and is adapted to affect said initial hinged opening of the lid portion 16 by contacting the pressure-sensitive area 38 of the rim portion 15 of the closure 14 upon pivoting of the selected container 11*z* to the filling position shown in FIG. 7. The abutment means 119 comprises two arm portions 120 which are each affixed to a respective sidewall 121 of the trough portion of the first trolley means 21. The arm portions 120 are transversely angled upwards from their respective points of attachment towards a resilient rubber bumper element 122 mounted in fixed relation between the two arms 120. The bumper element 122 is of rounded contour, and protrudes outwardly from between the arm portions 120 so as to make contact with the pressure-sensitive rim portion 38 upon the aforesaid pivoting motion. In this manner, the bumber element applies the required radially directed compressive force to the pressure-sensitive are 38 to release the lid portion 16 from its sealing relation with the rim portion 15, thereby causing initial opening of the hinged lid portion 16 at the filling position, as seen in FIG. 7. This action facilitates further opening of the lid portion 16 by the opening means 85 when it moves in the second longitudinal direction (i.e., to the left of FIG. 7) to the operative position illustrated in FIG. 8.

Figure 2:
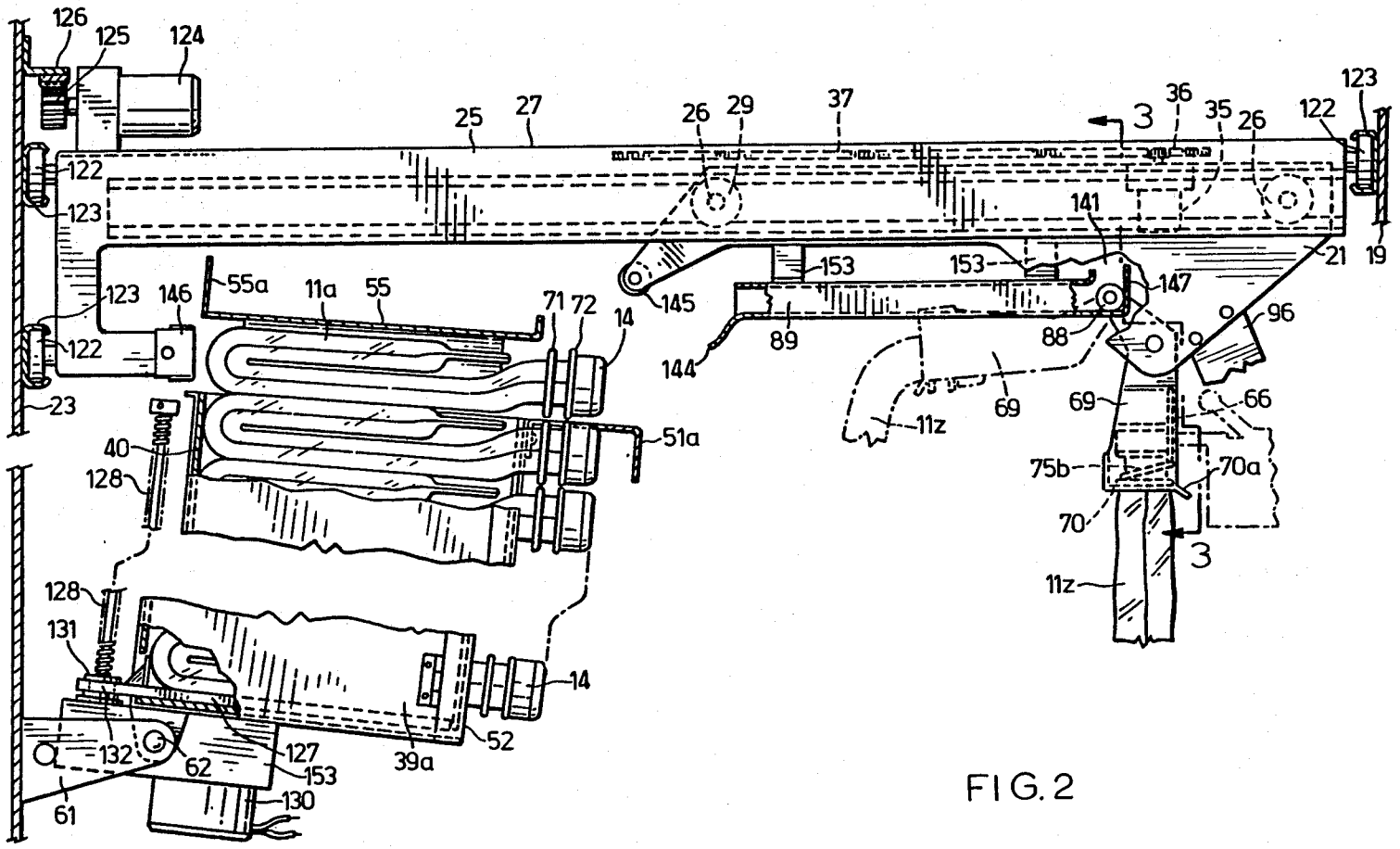
FIG. 2 is a longitudinal part sectional view, also partially cut-away, from FIG. 1, showing a selected one of the containers in an operative filling position.
Figure 2A:
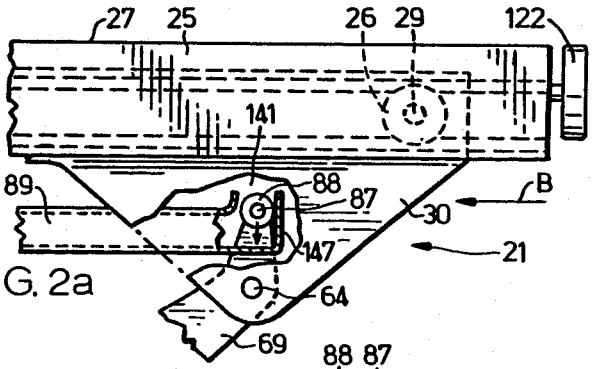
FIG. 2*a* is a detailed view of a portion of FIG. 2, wherein a first trolley means has moved a first small amount in the direction of an arrow B in FIG. 2 from the position shown in FIG. 2.
Figures 4, 5:
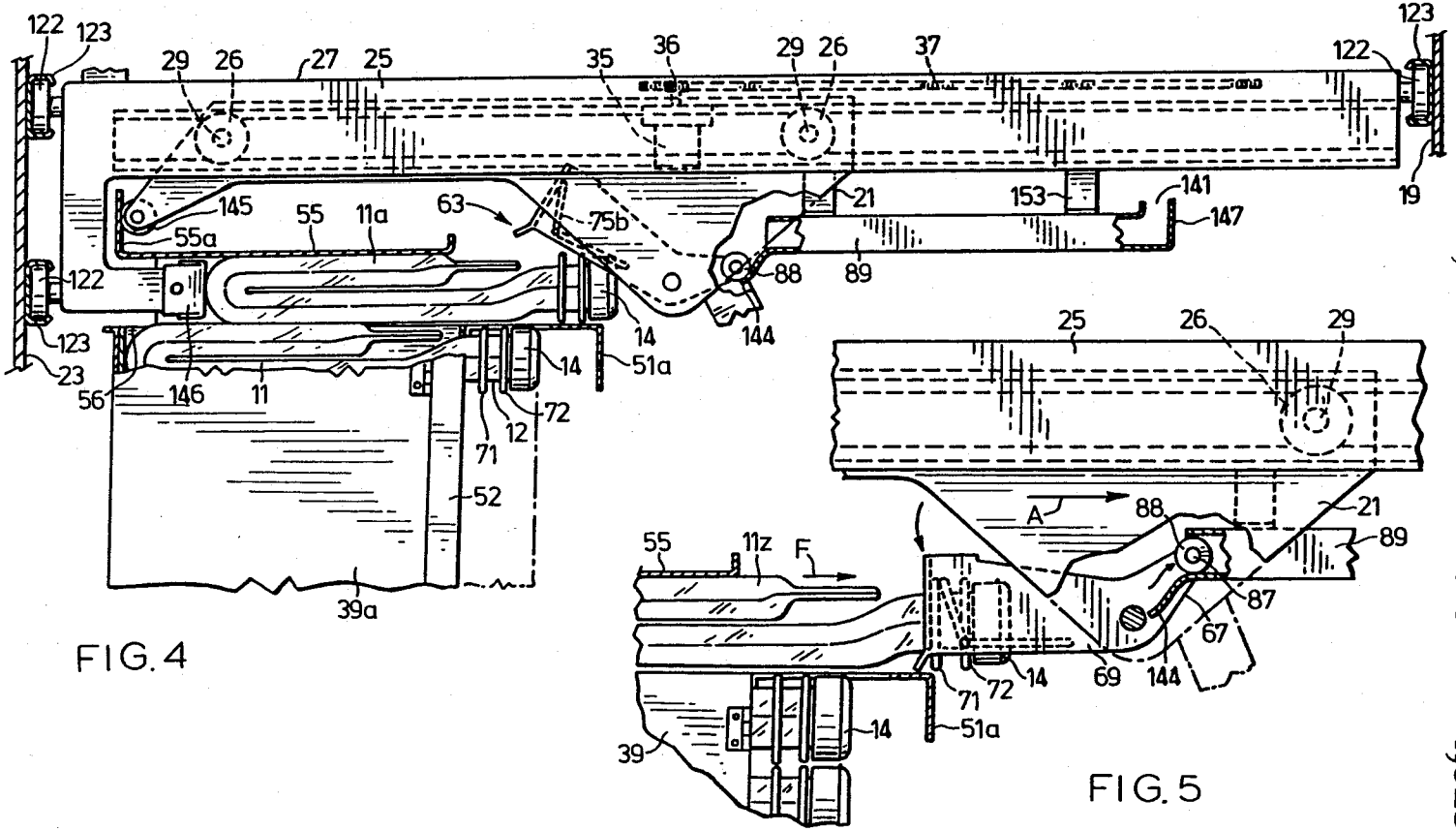
FIG. 4 is a view similar to FIG. 2, showing a selected container in position for gripping by a gripper means mounted on the first trolley means.
FIG. 5 is a view similar to FIG. 4, showing the gripper means gripping the selected container about its neck portion for withdrawal from a stack of similar containers loaded in a magazine means.

The second trolley means 25 is, as best seen in FIGS. 1 and 2, mounted for independent driven movement in the first and second opposed lateral directions so as to be selectively positionable adjacent a selected one of the plurality of magazine means 39. As seen in FIG. 1, the second trolley means 25 is positioned adjacent the rightmost magazine means, which in this Figure, constitutes the "selected" magazine means 39*a*. In this position the uppermost container 11*a* can be gripped from the selected magazine means 39*a* by the gripper means 62, as shown in FIGS. 4 and 5. The second trolley means 25 is mounted within the housing 20 for said positioning by means of opposed sets of end rollers 122 mounted for rotation at opposite longitudinal ends of the trolley means 25. The rollers 122 are mounted in corresponding parallel guide tracks 123 mounted respectively on the rear wall 20 and in front of the upper portion of the door member 19. An electrical drive motor 124 is mounted on top of the second trolley means 25 and engages, by means of a drive pinion 125, a rack member 126 rigidly mounted on the rear wall 20 in parallel relation to the guide tracks 123 mounted below. The electrical drive motor 124 is wired in conventional fashion to the microprocessor control means (not shown), and thereby drives the second trolley means 25 in the first and second lateral directions when called upon by the microprocessor control means to do so, as when a particular magazine means 39 is exhausted of containers 11.

As best seen in FIGS. 2 and 10, each magazine means 39 has positioned at its lower end, within its interior, a movable base plate 127 which is adapted for movement up and down the central cavity along a generally vertical axis central to the cavity. The purpose of this movable base plate 127 is to upwardly advance the containers 11 in the magazine once the uppermost container 11*a* has been selectively removed from the top of the stack, thereby providing for subsequent selection of the next container, which is, after such advancement, the uppermost container 11*a*. The base plate 127 enters into the cardboard sleeve 40 above the bottom 42 of the sleeve 40 through the opening left in the rear of the sleeve by tearing away of the bottom rear pull-tab 44, so as to situate itself below the lowermost container 11*b*, as seen in FIG. 2.

The base plate 127 is adapted for the aforesaid upward movement by means of a motor-driven screw-threaded shaft 128, the screw shaft being driven in conventional manner by a worm gear (not shown) drivingly connected o an electrical motor 130 mounted on the base 153. The screw shaft 128 engages a threaded bushing 131 held captive in a projecting ear portion 132 (FIG. 2) of the base plate 127. The ear portion is dimensioned to protrude through a vertically oriented rear slot 134 centrally positioned in the rear wall portion of the magazine housing to support the base plate 127. A microswitch (not shown) is positioned at the top of the magazine housing so as to be tripped by the base plate 127 upon reaching a predetermined position indicative of the selection of the last remaining container (i.e. the bottomost container 11*b*) from the cardboard sleeve 40. Tripping of the microswitch in this manner causes the microprocessor to activate the electrical motor 124 so as to move the second trolley means 25 in either lateral direction to the next adjacent magazine means with a full container sleeve 40. Moreover, the electrical motor 130 of the now empty magazine means 39 may be simultaneously reversed-energized to drive the base plate 127 downwardly to its bottomost position whereat a cut-out switch (not shown) may be contacted to stop such downward movement, thus readying the magazine means 39 for acceptance of a fresh sleeve 40.

A vertically oriented cutting wedge 133 (FIG. 2) is centrally positioned on the upper surface of the ear portion 132 in registry with the rear slot 134 and in contacting alignment with the middle perforation line 48 of the cardboard sleeve 40 so as to cause separation of the rear wall of the cardboard sleeve 40 along the middle perforation line 48 as the base plate 127 moves upwardly. This separation in turn allows for upward movement of the ear portion 132 and the attached base plate 127.

A delivery means in the form of a downwardly sloping delivery chute 136 is affixed to the access door 19 behind an access opening 137 so as to be adapted to deliver a selected container 11*z*, after filling and sealing, from the point of release from the gripper means 62 to a user dispensing area 138 positioned in the lower half of the access door 19. The delivery chute 137 swings outwardly with the access door 19 upon opening thereof, so as to allow unobtruded access to the magazine means 39 and the remainder of the components of the housing 20 for servicing thereof. Depending upon the weight of the filled container and the distance of drop from the release point to the chute 137, it may be desirable to include in the delivery means 136 additional overlapping reversed ramps or chutes to ensure controlled and safe delivery of the filled containers to the user dispensing area 138.

In use, a user inserts the required coinage into a coin slot 139 of a conventional coin actuated switch mechanism 140 positioned on the inside of the access door 19. The switch mechanism 140 is electrically wired to the microprocessor (not shown) so as to start the following preferred sequence of operations upon such activation.

Turning to FIGS. 1, 2, 2*a* and 3, the selected container 11*z* has been filled and sealed and is now ready to be released from the gripping means 62 to the sloping delivery chute 137 where it will slide to the user access area 138 for retrieval by the user. Activation of the switch mechanism 140 by insertion of appropriate coinage causes the microprocessor control means (not shown) to energize the electrical motor means 35, thereby driving the first trolley means 21 and the attached gripper means 62 with the filled container 11*z* in the second longitudinal direction towards the selected magazine means 39*a*. During such travel, the rollers 88 travel along and are guided by the contoured guide track 89, with the first gripper element 66 pivoting about the pivot shaft 64. As the first gripper element 66 first moves from the operative filling position shown in solid outline in FIG. 2, in the second longitudinal direction, and to the position shown in FIG. 2*a*, it will be seen that the rollers 88 first ride upwardly into a terminal opening 141 of the guide track 89, reaching their uppermost position as the pivot shaft 64 is immediately under the axle 87. Continued driven movement in this direction causes the first portion 75*a* of the wire bail loop 75 to contact the trip lever 81 and pivot the lever 81 into contact with the stop pin 142 (see FIG. 3*a*). Such contact with the stop pin 142 causes, upon continued movement of the first gripper element 66, the wire bail loop 75 to pivot about the pivot pins 77 so that the second portion 75*b* pulls the container neck portion out of the U-shaped slot in the terminal end portion, thus allowing the filled container to drop free of the gripping means 62 onto the sloping delivery chute 136. With the weight of the filled container removed from the first gripping element 66, a coil spring means 143 (see FIG. 3) mounted around the shaft housing 65, with one end in contact with the first gripper element 66 and the other free end in contact with the intermediate down plate 32 of the first trolley means 21, upwardly biases the first gripper element 66 with the attached members 75, 76 etc. to an intermediate position (not shown) where the terminal end portion 70 of the first gripper element 66 is in generally transverse orientation to the guide track 89. (Such a general orientation is shown in FIG. 5 at a later container selection stage of the process.) The rollers 88 of the first gripper element 66 continue to move along the guide track 89 until they drop down a terminal ramped portion 144, which, under the biasing of the coil spring 143, causes the first gripper element 66 to pivot further upward to the orientation shown in FIG. 4 in which it is above the position to be occupied by the neck of the next-selected container 11*a*.

Movement of the first trolley means 21 in the second longitudinal direction to the position shown in FIG. 4 causes a downwardly-protruding terminal roller element 145 to urgingly contact an upturned portion 55*a* of the top end member 55 of the magazine housing, thereby tilting the selected magazine means 39*a* from its operative rest position, as shown in FIG. 1, in the second longitudinal direction to the position shown in FIG. 4. As the tiling of the selected magazine means 39*a* progresses, the uppermost container 11*a* is contacted from behind by an abutment portion 146 of the first trolley means 21, which portion 146 protrudes into the cardboard sleeve 40 through the opening created by removal of the top rear pull-tab 45. This contact causes the uppermost container 11*a* to be partially displaced from its oriented stacked relation within the selected magazine means 39*a* outwardly with its neck portion 12 on the ledge member of the latch 51*a*, as shown in FIG. 4, so as to facilitate its gripping by the gripper means 62.

At the position shown in FIG. 4, the gripper means 63 is strategically positioned over the neck portion of the uppermost container 11*a*. At this point, energization of the electric motor 35 reverses, causing the first trolley means 21 and the attached first gripper element 66 to move in the opposite first longitudinal direction. Movement of the rollers 88 up the ramped portion 144 causes downward pivoting of the first gripper element 66, against the biasing of the coil spring 143, to the position shown in FIG. 5. In the FIG. 5 position, it will be seen that the second rib 72 of the uppermost container 11*a* is firmly gripped, with the aide of the bail springs 76, between the terminal end portion 70 of the first gripper element 66 and the second portion 75*b* of the wire bail loop 74. At this point, the uppermost container 11*a* has been "selected", and is now the "selected container" 11*z*, as that term is used in the claims hereof.

After selecting the uppermost container 11*a*, the first trolley means 21 continues moving in the first longitudinal direction, as shown by the arrow F of FIG. 5, to the position where the first gripper element 66 and the selected container 11*z* are as shown in phantom outline in FIG. 2. The positioning of the first trolley means 21 is, for simplicity of illustration, not shown at this point, but such positioning is slightly to the left of the position thereof shown in solid outline in FIG. 2. In FIG. 2, it will be noted that the selected magazine means 39*a* has returned to its operative rest position and that the rollers 88 have just contacted an end wall 147 of the guide track 89. However, at the phantom position, the first gripper element 66 is still spring biased to the same general orientation as that of FIG. 5. Continued movement of the first trolley means 21 in the first longitudinal direction to the position shown in solid outline in FIG. 2 causes the first gripper element 66 to pivot downwardly, so that the selected container 11*z* is relocated to the operative filling position illustrated in solid outline, at which position the pressure sensitive area 38 of the rim portion 15 of the closure 14 is contacted by the abutment means 119, as best seen in FIG. 7. This contact causes initial opening of the lid portion 16 of the container, as described above and as seen in FIG. 7.

Once the selected container 11*z* is at the operative filling position of FIG. 7, the electrical drive motor 35 is de-energized and the electrical motor 97 is energized under the control of the microprocessor means, so as to drive the third trolley means 92 in the second longitudinal direction. This movement causes the central portion 103 of the wedge means 90 to push against the operative underside 16*a* of the lid portion 16, thereby urging the lid portion to the operatively open position shown in FIGS. 8 and 9. During this movement, the side portions 104 of the wedge means 90 slide past the sides of the lid portion 16. Once the opening means 85 reaches the position illustrated in FIG. 8, the electrical drive motor 97 is de-energized while the filling step proceeds.

In obtaining the positioning of FIG. 8, the rollers 111 on the displacement means 107 have proceeded up the inclined portion 114 of the track 112, thereby causing the plate 107 of the dispensing means to pivot the dispensing nozzle 106 into sealing engagement with the raised lip portion 148 of the closure 14. A microswitch (not shown) is activated by contact with the pivoted plate 107, thereby signalling the microprocessor control means t open the solenoid driven flow valve 154 and to begin pumping of the flowable substance from the bulk storage tank (not shown) through the filling tube 115. When the pre-determined amount of flowable substance is introduced in this manner into the selected container 11*z*, as determined by the flow meter (not shown), the microprocessor control means signals the solenoid driven flow valve 154 to close it and to cease pumping of the flowable substance.

At this stage the electrical drive motor 97 is reverse energized, causing the third trolley means 92 to move in the first longitudinal direction as indicated by the arrow D of FIG. 8. This movement in turn causes the filler means 105, including the dispensing nozzle 106, to withdraw clear of the closure 14. Moreover, continued movement in this direction causes the roller means 117 to contact the operative top surface 16*b* of the lid portion 16, thereby mechanically closing the hinged lid portion 16 (as indicated by the broken arrow E) so as to seal the opening 13. A ring sealing lip 149 located on the operative underside 16*a* of the lid portion 16 fits inside of the lip portion 148 on the rim portion 15 to ensure positive sealing.

Once the selected container 11*z* is filled and sealed in this manner, the microprocessor control means then de-energizes the drive motor 97 and waits until it is again activated by the coin activated switch 140, when the entire process is again repeated.

It will be appreciated that numerous structural departures or variations from the apparatus illustrated will be immediately obvious to those skilled in the design and construction of vending machines without departing from the spirit and scope of the claimed inventive apparatus. Moreover, the inventive process claimed may be carried out by a wide variety of machines having considerably different appearances than the specific embodiment of machine illustrated. Nonetheless, such machines or processes will come within the spirit and scope of the invention where they include the essential elements of the invention as claimed.

As to the apparatus aspect, for example, the delivery chute 137 may be constructed as a plurality of separately walled chutes, the plurality corresponding to the plurality of magazine means. In such case, the microprocessor control means could be programmed to cause filling and dispensing of a specified number of filled containers from each magazine means into the respective chute. When this number is depleted by users to a predetermined level, as determined by weight sensors or other sensors associated with the respective delivery chute, further containers could be filled and dispensed to again load the delivery chute to the specified number of filled containers. When the supply of empty containers in a particular magazine means is depleted, the second trolley means 25 would then advance to the next magazine means full of containers and repeat the filling process. The filled containers in this instance could be paid for by the consumer at the retail check-out counter or, as a further option, standard coin-operated unit access technology could be applied to the front of the cabinet means 18, thereby allowing only selection of a single filled container from the delivery chute upon insertion of the proper coinage.

Another obvious change is to utilize continuous cables or belts, cranks or other conventional drive technologies to drive the first, second and third trolley means in place of the rack and pinions drives described.

Additionally, it should be noted that the detailed description of the operation of the illustrated embodiment has proceeded on the basis that a filled container was ready for immediate dispensing upon insertion of coinage by the user. The apparatus 10 can just as easily operate from a starting position where the selected container 11*z* as shown in FIG. 1 is empty and the filling step previously described commences upon insertion of the appropriate coinage. Moreover, the activation could also occur at the selection stage shown in FIGS. 4 and 5. In other words, as the inventive apparatus is designed to perform all of the function steps of the process claims in a continuous loop, all that is required in any particular user activation is that all of the process steps be sequentially performed, although the starting and stopping points in the process loop may vary.

We claim:

1. A process of machine dispensing a discrete quantity of a bulk liquid into a container having a hinged, substantially annular closure fitted on a neck portion of the container in a closed configuration comprising, in order, the steps of:

mechanically selecting said container from an aligned stack of similar containers;

mechanically positioning said selected container in a predetermined filling position with the closure in a predetermined radially indexed filling orientation;

mechanically opening the closure to access said container;

mechanically introducing a metered quantity of the bulk liquid into the container through the opened closure;

mechanically closing the closure to seal said container; and mechanically delivering said sealed container of liquid to a dispensing access of the machine.

2. The process as set forth in claim 1, wherein said hinged closure has an annular rim portion and a hinged lid portion, and wherein the closure opening step includes the sub-step of radially compressing a pressure sensitive area of said rim portion so as to initially open the hinged lid portion to an open condition, and, thereafter, applying an opening force against the operative underside of said lid portion thereby to displace the hinged lid portion of said closure through a predetermined distance to affect an operative degree of opening thereof.

3. The process as set forth in claim 2, wherein the containers are vertically stacked and wherein the selection step includes:

displacing said selected container from an aligned uppermost position in said stack by gripping the neck portion of the container and withdrawing the container from the stack; and, wherein the positioning step includes:

pivoting said selected container so gripped in downward pivoting motion about the neck portion thereof into the filling position.

4. The process as set forth in claim 3 wherein, at the filling position, the selected container is in a substantially vertically suspended configuration with the neck portion substantially vertically oriented.

5. The process as set forth in claim 4, wherein said pivoting of the selected container into the filling position causes the pressure-sensitive area of the rim portion to contact a bumper means, thereby radially compressing said area so as to initially open the hinged lid portion.

6. The process as set out in claim 5, wherein said opening force is provided by progressive urging of wedge means against the operative underside of the lid portion.

7. The process as set forth in claim 6, wherein the metered quantity of the bulk liquid is introduced into the selected container by means of a dispensing nozzle mechanically positioned over the container at the filling position in operative filling engagement with the opened closure.

8. The process as set forth in claim 7, wherein the introducing step includes raising the dispensing nozzle clear of the opened closure after the metered quantity of the bulk liquid is introduced into th selected container.

9. The process as set forth in claim 8, wherein the closing step includes running a roller means across the upper operative surface of the lid portion of the closure in the opposite direction of said progressive urging of the wedge means thereby to effect said sealing of the selected container.

10. A container filling and dispensing apparatus for use with a plurality of containers each having a mouth of generally circular cross-section providing access to the interior of the container and a closure having a generally annular rim portion adapted for encircling fixation around the mouth of the container, a hinged lid portion positionable over the mouth for closing of the container, said apparatus comprising:

magazine means adapted for receiving said plurality of containers in oriented stacked relation therein;

opening means for opening the closure of said selected container;

container positioning means for relocating a selected one of said stacked containers to a predetermined operative filling position with the rim portion in a predetermined radially indexed orientation relative to said opening means;

liquid dispensing means for dispensing a metered quantity of a bulk liquid through the mouth into the interior of said selected container at said filling position;

closing means for closing the closure of the selected container in sealing relation with the mouth; and, means to deliver said selected container to a dispensing access of the apparatus.

11. The apparatus as set forth in claim 10, wherein said container positioning means includes gripper means for gripping the container adjacent the mouth for fully withdrawing said container from the magazine into suspended relation for positioning at said operative filling position.

12. The apparatus as set forth in claim 11, wherein the rim portion of each closure has a pressure-sensitive area adapted to facilitate initial opening of the hinged lid portion upon the application thereto of a radially directed compressive force of threshold magnitude, and wherein an abutment means is provided adjacent the filling position to contact said pressure-sensitive area upon said relocation thereby to apply such a compressive force to said pressure-sensitive area.

13. The apparatus as set forth in claim 12, wherein said opening means additionally comprises a wedge means for contacting the operative underside of the lid portions so as to urge the hinged lid portion to an operatively opened position.

14. An apparatus for filling and dispensing containers, each container having a neck portion defining a generally circular opening to the container and a closure positioned on the neck portion, said closure having a rim portion grippingly surrounding the neck portion and a lid portion connected by hinge means to the rim portion so as to selectively seal the opening, the device comprising:

cabinet means forming a housing;

first trolley means mounted within the housing so as to be movable in first and second opposed longitudinal directions;

magazine means postioned within the housing and adapted to receive a plurality of said containers in oriented stacked relation therein with the neck portions of the containers protruding from the magazine means substantially in said first longitudinal direction;

gripper means pivotally mounted on the first trolley means and adapted for gripping a selected one of said containers about the neck portion for withdrawal of the selected container from the magazine means upon movement of the first trolley means in said first longitudinal direction and for pivoting said gripped container to a filling position whereat the neck portion is oriented generally transversely to said first and second longitudinal directions;

opening means mounted on the first trolley means and adapted for movement in said longitudinal directions relative to said first trolley means and for engagement with the operative underside of said lid portion when moving in said second longitudinal direction, thereby to urge said lid portion to an operatively open position, at which position said opening means are clear of the container opening;

filler means having a dispensing nozzle mounted within the housing which nozzle is adapted to be positionable over said opening when the lid portion is in the operatively open position thereby to allow filling of the selected container with a metered quantity of a flowable substance, and which nozzle is adapted for withdrawal clear of the closure subsequent to said filling;

closing means mounted on the first trolley means and adapted for movement in said longitudinal directions relative to said first trolley means in coordination with said movement of said opening means so as to engage the operative top surface of the lid portion when moving in said first longitudinal direction subsequent to said withdrawal of the dispensing nozzle, thereby to seal the opening;

release means positioned within the housing and adapted to cause release of the selected container from the gripper means after filling and sealing of the selected container; and, delivery means adapted to deliver the filled and sealed container from the point of said release to a user dispensing area.

15. The apparatus according to claim 14, wherein the rim portion is adapted to facilitate initial hinged opening of the lid portion upon application of a radially directed compressive force of threshold magnitude to a pressure-sensitive area of the rim portion, and wherein the device additionally comprises:

abutment means mounted on the first trolley means and adapted to affect said initial hinged opening of the lid portion by contacting said pressure-sensitive area of the closure upon pivoting of the selected container to the filling position thereby to apply said radially directed compressive force.

16. The apparatus according to claim 15, wherein said magazine means comprises a plurality of magazine means arranged within the housing to define first and second opposed lateral directions, and, additionally comprising a second trolley means upon which said first trolley means is mounted for independent driven movement in said first and second longitudinal directions as aforesaid, the second trolley means being itself mounted within the housing so as to be independently movable in said first and second opposed lateral directions so as to be selectively positionable adjacent a selected one of said plurality of magazine means thereby to allow said gripping of said selected container by said gripper means.

17. The apparatus according to claim 16, wherein said cabinet means includes a door means to which said delivery means and said user dispensing area are affixed for movement with the door in order to facilitate access to the housing for servicing.

18. An apparatus according to claim 17, wherein said plurality of magazine means are tiltable towards said door means to facilitate loading of said plurality of containers in stacked relation therein.

19. An apparatus according to claim 18, wherein said plurality of magazine means are adapted to receive said containers in doubled over relation therein.

20. An apparatus according to claim 19, wherein said plurality of magazine means is each separately tiltable in said second longitudinal direction from an operative rest position upon urging contact by said first trolley means so as to partially displace said selected one container from its oriented stacked relation within the respective magazine means for said gripping by said gripping means.

21. An apparatus according to claim 20, wherein said filler means includes displacement means adapted to provide relative displacement of said nozzle into operative engagement with said opening for said filling of the selected container.

22. The apparatus according to claim 21, wherein said displacement means is mounted on a third trolley means, which third trolley means is adapted for independent driven movement in said first and second longitudinal directions.

23. The apparatus according to claim 22, wherein said third trolley means is carried by said first trolley means.

24. The apparatus according to claim 23, wherein said opening means includes a wedge means for engaging the operative underside of the lid portion as aforesaid.

25. The apparatus according to claim 24, wherein said closing means includes a roller means for engaging the operative top surface of the lid portion as aforesaid.

26. The apparatus according to claim 25, wherein said wedge means and said roller means are each structurally connected to said third trolley means for coordinated travel therewith in said first and second longitudinal directions.

27. The apparatus according to claim 26 wherein said filling nozzle is in fluid communication with a bulk storage tank remote from the apparatus from which tank said flowable substance is obtained.

* * * * *